US008529370B1

(12) United States Patent
Galloway et al.

(10) Patent No.: US 8,529,370 B1
(45) Date of Patent: Sep. 10, 2013

(54) GOLF CLUB HEAD WITH A COMPRESSION-MOLDED, THIN-WALLED AFT-BODY

(75) Inventors: J. Andrew Galloway, Escondido, CA (US); Martin Peralta, Oceanside, CA (US); William C. Watson, Temecula, CA (US)

(73) Assignee: Callaway Golf Company, Carlsbad, CA (US)

( * ) Notice: Subject to any disclaimer, the term of this patent is extended or adjusted under 35 U.S.C. 154(b) by 339 days.

(21) Appl. No.: 12/886,773

(22) Filed: Sep. 21, 2010

Related U.S. Application Data

(60) Provisional application No. 61/245,583, filed on Sep. 24, 2009.

(51) Int. Cl.
*A63B 53/04* (2006.01)

(52) U.S. Cl.
USPC ..... 473/347

(58) Field of Classification Search
USPC ..... 473/324–350
See application file for complete search history.

(56) References Cited

U.S. PATENT DOCUMENTS

| | | | | |
|---|---|---|---|---|
| 5,916,682 | A * | 6/1999 | Horii et al. | 428/408 |
| 6,368,234 | B1 | 4/2002 | Galloway | |
| 6,398,666 | B1 | 6/2002 | Evans et al. | |
| 6,471,603 | B1 | 10/2002 | Kosmatka | |
| 6,471,604 | B2 * | 10/2002 | Hocknell et al. | 473/334 |
| 6,582,323 | B2 | 6/2003 | Soracco et al. | |
| 6,607,452 | B2 | 8/2003 | Helmstetter et al. | |
| 7,261,646 | B2 * | 8/2007 | De Shiell et al. | 473/345 |
| 7,281,994 | B2 * | 10/2007 | De Shiell et al. | 473/345 |
| 7,320,646 | B2 | 1/2008 | Galloway | |
| 7,390,269 | B2 | 6/2008 | Williams et al. | |
| 7,431,666 | B2 | 10/2008 | Vincent et al. | |
| 7,448,960 | B2 | 11/2008 | Gibbs et al. | |

FOREIGN PATENT DOCUMENTS

JP 2004229869 A * 8/2004

* cited by examiner

*Primary Examiner* — Alvin Hunter
(74) *Attorney, Agent, or Firm* — Michael A. Catania; Rebecca Hanovice; Sonia Lari

(57) ABSTRACT

A golf club head composed of a face component and an aft body composed of a long fiber material. The aft body is composed of a compression molded material. The compression molded aft-body is composed of two pieces which are bonded to a metal face component.

7 Claims, 2 Drawing Sheets

View of the face-body joint.

GOLF CLUB HEAD WITH A COMPRESSION-MOLDED, THIN-WALLED AFT-BODY

CROSS REFERENCES TO RELATED APPLICATIONS

The Present Application claims priority to U.S. Provisional Patent Application No. 61/245,583, filed on Sep. 24, 2009, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a multiple material golf club head. More specifically, the present invention relates to a multiple material golf club head with a compression-molded, thin-walled aft body.

2. Description of the Related Art

The prior art discloses multiple material golf club heads.

There are various problems with the current process for manufacturing multiple material golf club heads.

One problem is with the standard compression molding process, the hard metal tooling on both sides of the part makes undercuts impossible without significant increases in tool complexity.

Another problem is the molding compounds are not designed to be used in parts with very thin walls. When wall thicknesses are below approximately 0.080 inches, most standard molding compounds are difficult to compression mold.

Another problem is that standard molding compounds are not as strong, stiff, or tough as laminated composites made with similar matrix and fiber types.

Another problem is the raw materials for the current laminates are quite expensive. The cost is compounded by the very high scrap rate.

Another problem is that using prepreg requires hand placement of each layer of material into a mold which is a time-consuming and labor-intensive process.

Another problem is that with current latex bladders we are able to avoid undercut constraints, but we lose definition on the inside of our parts. The metal tooling dictates OML of the parts quite well, but the part thickness and IML are determined by the number of plies placed in each area and the amount of pressure exerted on the area by the bladder during the cure. As a result, it is difficult to predict the mass properties of the Fusion body before a part is made. One-piece bladder molded driver bodies do not work well with a body-over-face joint. The lack of precision on the inside of the head makes it difficult to control the geometry of the body where it would meet up with the face. Bladder molded multiple material driver design had been restricted to body-under-face joints so that the body bond surface is a well controlled OML surface. Typical epoxy-based prepregs are designed to cure in 20-30 minutes. In the current multiple material golf club head fabrication process, the latex bladders used to apply pressure during the cure cycle can only be used 2 or 3 times before they need to be discarded. Bladders are a significant cost in the current multiple material driver manufacturing process.

BRIEF SUMMARY OF THE INVENTION

One solution, instead of trying to mold the whole body at once, is splitting the aft-body component into two (or more) pieces. By splitting the part, we are able to make two separate pieces which are relatively easy to mold. The parts are bonded together to form a complete composite aft-body. The aft-body is then finished and bonded to a finished face cup in the same way current multiple material driver golf club heads are assembled. The relevant range of thickness for driver heads is 0.020 inch to 0.080 inch, and the present invention is able to mold to thicknesses throughout this range, preferably using a carbon/vinyl ester material. Alternatively, epoxy-based molding compounds are utilized since these materials provide better strength and impact resistance than vinyl ester. The use of smaller diameter fiber bundles (3 k tows versus the more standard 12 k tows) assist with molding thin components for a golf club head.

Another concern with the thin compression molded parts is variation in strength. Preliminary testing shows that the variation in strength increases as specimen thickness decreases. Without sufficient thickness, the random nature of the fiber distribution in these kinds of materials can lead to weak spots in the finished golf club head component. The preferred method that these materials can approach strength consistency is if the final golf club head component is thick enough (or the fiber bundle layers are thin enough) to allow for fiber orientation "averaging" through the thickness. In addition to making molding easier, smaller fiber bundle diameters assist with strength consistency by allowing for a more uniform distribution of fiber orientations for a given part thickness.

While standard molding compounds have a lower strength, stiffness and impact toughness than continuous fiber laminates, there are several ways that improve the material properties of these standard molding compounds. One way of improving the material properties of standard molding compounds is to utilize longer fibers and higher fiber content. In a preferred method, fibers as long as 2 inches are utilized to improve the material properties of standard molding compounds. In addition or alternatively, adding micro- and nano-fillers (carbon nanotubes, nanoclays, etc.) to the matrix material increases the material properties of standard molding compounds. Another approach to improve the material properties of standard molding compounds is to use a combination of continuous fiber-reinforcement (prepreg) and molding compounds.

Molding compounds allow for a reduction in scrap when compared to laminated parts thereby providing savings.

Exact placement of the raw material in the molding tool is not required in therefore the raw material is used in a form that allows for just one piece per golf club head component, which has the effect of eliminating the labor intensive lay-up process.

The standard compression molding process preferably uses hard metal tooling on both sides of the golf club head component. During the molding process, the material is forced into the cavity between the two tool surfaces. As a result, the IML surface is a precise as the OML surface. This capability allows for blending of sharp IML corners to alleviate stress concentrations.

A two-piece compression molded body allows for a body-over face joint or a body-under face joint. The hard metal tooling on the IML allows for a precise bond surface geometry on either side of the golf club head component. Vinyl ester matrix molding compounds preferably cure in as little as one minute. Quick curing epoxy-based molding compounds are have cure times as low as 5 minutes. Compression molding eliminates the need for any consumable bladder. Pressure is applied to both sides of the golf club head component with hard metal tool surfaces.

The present invention preferably comprises a driver aft-body, which is made up of two or more compression molded parts. The driver aft-body is bonded to a metallic face cup to form a golf club head. The compression molded parts have a thickness between 0.020 inches and 0.080 inches, except for areas which may be thicker to accommodate joint geometry. The joints may have features specifically built in to prevent misalignment during bonding and assembly (see illustrations below). Molding compounds of interest will be reinforced by fibers, including carbon, fiberglass, aramid or any combination of the three. The fibers in the molding compound will be between ¼" and 2" long.

The fiber bundles used to create the molding compound are 1 k-12 k tows.

The matrix material for the molding compound is preferably a thermosetting (epoxy, polyester, vinyl ester, etc.) or a thermoplastic (nylon, polycarbonate, PPS, PEKK, PEEK, etc.).

The fiber volume fraction of the molding compounds is up to 70%.

The types of adhesives used to join the golf club head components together include, but are not limited to epoxies, acrylics, and films.

The compression molded body is preferably composed of more than one piece which is joined together after molding. The compression molded parts have wall thicknesses in the 0.020-0.080 inch range. The compression molded parts are joined together and bonded to a metallic face cup. The compression molded parts are preferably a combination of continuous reinforcement and molding compounds.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
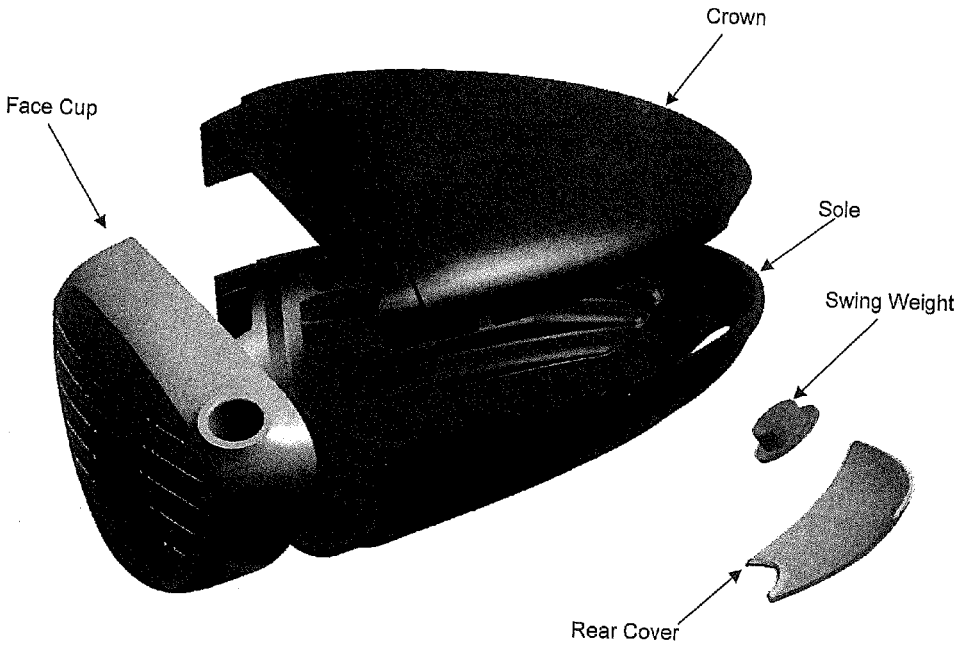
FIG. 1 is an exploded view of a golf club head.
Figure 2:
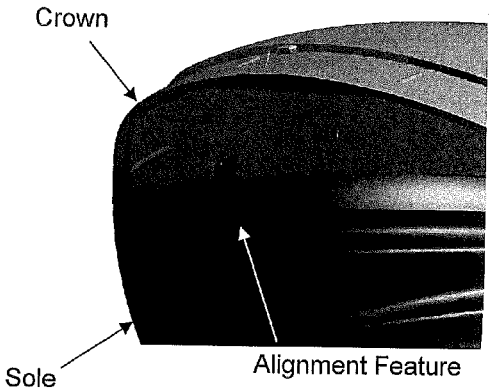
FIG. 2 is an isolated view of an alignment feature of a crown section of an aft-body of a golf club head.
Figure 3:
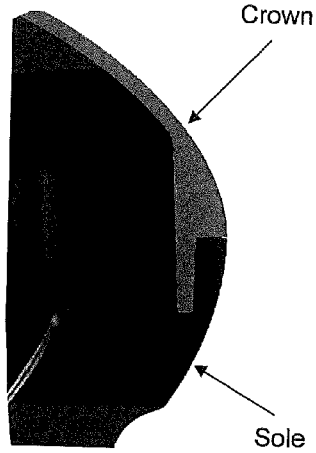
FIG. 3 is an isolated view of a crown-sole joint of an aft-body of a golf club head.
Figure 4:
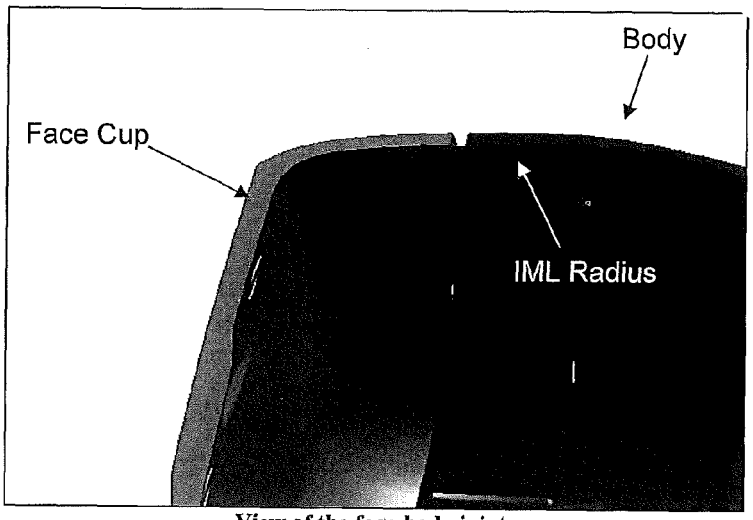
FIG. 4 is an isolated view of a face component aft body joint of a golf club head.
Figure 5:
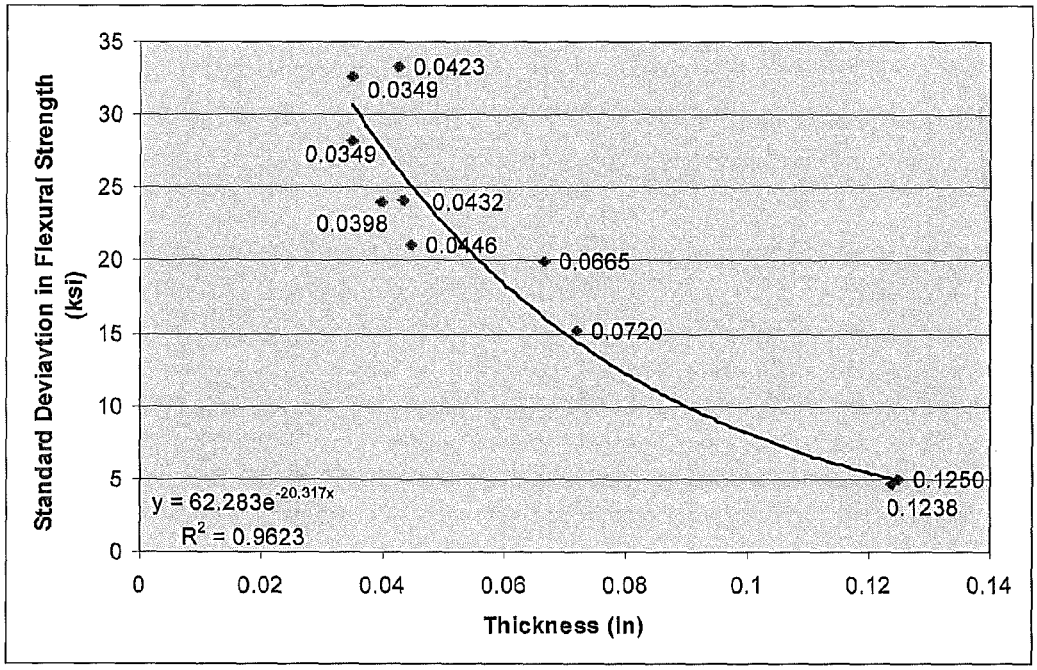
FIG. 5 is a graph of a standard deviation n in flexural strength versus thickness.

As shown in the figures, the club head has alignment features for proper assembly. As shown in FIG. 5, the standard deviation in flexural strength decreases as the wall thickness increases.

The final golf club head is preferably as disclosed in U.S. Pat. No. 6,582,323 for a Multiple Material Golf Club Head, which is hereby incorporated by reference in its entirety.

Alternatively, the final golf club head is preferably as disclosed in U.S. Pat. No. 7,320,646 for a Multiple Material Golf Club Head, which is hereby incorporated by reference in its entirety.

Alternatively, the final golf club head is preferably as disclosed in U.S. Pat. No. 7,431,666 for a Golf Club Head With A High Moment Of Inertia, which is hereby incorporated by reference in its entirety.

Alternatively, the final golf club head is preferably as disclosed in U.S. Pat. No. 7,390,269 for a Golf Club Head, which is hereby incorporated by reference in its entirety.

Variable face thickness patterns of the striking plate insert are disclosed in U.S. Pat. No. 6,471,603, for a Contoured Golf Club Face, U.S. Pat. No. 6,368,234 for a Golf Club Striking Plate Having Elliptical Regions Of Thickness, U.S. Pat. No. 6,398,666 for a Golf Club Striking Plate With Variable Thickness, U.S. Pat. No. 7,448,960, for a Golf Club Head With Face Thickness which are all owned by Callaway Golf Company and which pertinent parts related to the face pattern are hereby incorporated by reference.

The mass of the club head of the present invention ranges from 165 grams to 250 grams, preferably ranges from 175 grams to 230 grams, and most preferably from 190 grams to 205 grams. Preferably, the subassembly preferably has a mass ranging from 140 grams to 200 grams, more preferably ranging from 150 grams to 180 grams, yet more preferably from 155 grams to 166 grams, and most preferably 161 grams. The crown component has a mass preferably ranging from 4 grams to 20 grams, more preferably from 5 grams to 15 grams, and most preferably 7 grams.

The golf club head preferably has that ranges from 290 cubic centimeters to 600 cubic centimeters, and more preferably ranges from 330 cubic centimeters to 510 cubic centimeters, even more preferably 350 cubic centimeters to 495 cubic centimeters, and most preferably 415 cubic centimeters or 470 cubic centimeters.

The center of gravity and the moment of inertia of a golf club head are preferably measured using a test frame ($X^T$, $Y^T$, $Z^T$) and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety.

The moment of inertia, Izz, about the Z axis for the golf club head preferably ranges from 2800 g-cm$^2$ to 5000 g-cm$^2$, preferably from 3000 g-cm$^2$ to 4500 g-cm$^2$, and most preferably from 3750 g-cm$^2$ to 4250 g-cm$^2$. The moment of inertia, Iyy, about the Y axis for the golf club head preferably ranges from 1500 g-cm$^2$ to 4000 g-cm$^2$, preferably from 2000 g-cm$^2$ to 3500 g-cm$^2$, and most preferably from 2400 g-cm$^2$ to 2900 g-cm$^2$. The moment of inertia, Ixx, about the X axis for the golf club head 40 preferably ranges from 1500 g-cm$^2$ to 4000 g-cm$^2$, preferably from 2000 g-cm$^2$ to 3500 g-cm$^2$, and most preferably from 2500 g-cm$^2$ to 3000 g-cm$^2$.

The golf club head preferably has a coefficient of restitution a ("COR") ranging from 0.81 to 0.875, and more preferably from 0.82 to 0.84. The golf club head preferably has a characteristic time ("CT") as measured under USGA conditions of 256 microseconds.

The aft body is preferably constructed from a "long fiber" material consisting of the following combination of constituent materials: 20-70% carbon (graphite) fiber b volume; 30-80% thermoplastic or thermoset polymer resin by volume; Up to 20% of other filler materials, including other fibers (Kevlar, fiberglass or the like).

The constituent materials having the following properties: thermoplastic or thermoset polymer resin having a specific gravity between 1.0 and 1.7; carbon (graphite) fiber specific gravity between 1.6 and 2.1; carbon (graphite) fiber tensile modulus of between 25 and 50 Msi.

Prior to processing (entering into the injection molding hopper), into the club head body or specimen the constituent materials are combined (by a material supplier such as Ticona) into a "long fiber" precursor material with the following properties: Carbon fibers are nominally greater than 0.100 inch long.

After processing (plastication and injection into a closed mold), the material has the following properties as measured by testing molded coupons. Carbon fibers are generally dispersed throughout the material in a non-orderly manner. The tensile strength as measured by testing a standard dog-bone test specimen per ASTM-D-638 is greater than 20 Ksi. The tensile modulus as measured by testing a standard dog-bone test specimen per ASTM-D-638 is greater than 2 Msi. The toughness as measured by testing a standard notched TZOD specimen per ASTM-D-256 is greater than 2 ft-lb/inch. The specific gravity is between 1.2 and 2.0. After processing into a club head the nominal thickness of the body is not greater than 0.050" and is preferably 0.040" or less (may be locally thicker).

The present invention preferably uses collimated "long fiber" thermoplastic precursor material such as that supplied by Ticona Corporation. Some examples of this type of material are as follows: PA66-CF40 (polyamide 66 with 40% long carbon fiber); PPA-CF40 (polyphthalamide with 40% long carbon fiber); PPS-CF50 (polyphenylene sulfide with 50% long carbon fiber); TPU-CF50 (thermoplastic polyurethane elastomer with 50% long carbon fiber).

The long fiber precursor, or pellet, is shown below. The pellet is approximately 0.43 inch long as shown, but may be adjusted to be any length greater than 0.10 inch.

The key discovery related to this material is that the combination of strength and toughness available from "long fiber" material is adequate for the club head body application. Whereas the strength and toughness available from short fiber reinforced polymer or unreinforced polymer is not adequate. The strength and toughness available from laminated composite is more than adequate, but at a higher cost and slower cycle time.

The conclusions are based on results of air cannon testing preformed to simulate accelerated exposure to golf ball strikes. The relative strengths and toughness based on air cannon testing is shown in Table One.

TABLE ONE

| MATERIAL | AIR CANNON HITS TO FAILURE AT 110 MPH IN THE LOW CENTER |
|---|---|
| Unreinforced polymer | 1 |
| PSU | 1 |
| PPA 40% carbon Short Fiber | 5 |
| PBT 30% carbon Short Fiber | 1 |
| PET 30% carbon Short Fiber | 1 |
| RTPU 20% carbon Short Fiber | 1 |
| PEI 10% carbon Short Fiber | 1 |
| PC/ABS 10% carbon Short Fiber | 1 |
| POM 10% glass Short Fiber | 1 |

TABLE ONE-continued

| MATERIAL | AIR CANNON HITS TO FAILURE AT 110 MPH IN THE LOW CENTER |
|---|---|
| PP 30% glass Short Fiber | 1 |
| PA6 30% glass Short Fiber | 1 |
| PA66 40% carbon LONG FIBER | 2714 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A method for forming an aft-body of golf club head, the method comprising:

combining a carbon fiber material in an amount of 20-70 volume % of the combination with a resin material in an amount of 30-80 volume % of the combination to form a pre-processing material;

forming the pre-processing material into a long fiber precursor material, wherein the long fiber precursor material has a carbon fiber of at least 0.43 inches in length;

compressing the long fiber precursor material into a closed mold for a component of an aft-body of a golf club head; and forming the component of the aft-body of a golf club head.

2. The method according to claim 1 wherein the component of the aft-body has a wall thickness ranging from 0.020 inch to 0.080 inch.

3. The method according to claim 1 wherein the compression molded compound comprises a carbon/vinyl ester material.

4. The method according to claim 1 wherein the compression molded compound comprises an epoxy based material.

5. The method according to claim 1 wherein the compression molded compound comprises a high fiber count compression molded material.

6. The method according to claim 1 wherein the compression molded compound comprises carbon nano-tubes and/or nano-clays.

7. The method according to claim 1 wherein the compression molded compound comprises a thermoplastic material selected from the group consisting of nylon, polycarbonate, PPS, PEKK and PEEK.

* * * * *